United States Patent [19]

Kelly

[11] Patent Number: 4,984,697

[45] Date of Patent: Jan. 15, 1991

[54] LEAKAGE PREVENTING BABY BOTTLE

[76] Inventor: Donna Kelly, 4 Bugle Ct., Howell, N.J. 07731

[21] Appl. No.: 463,537

[22] Filed: Jan. 11, 1990

[51] Int. Cl.[5] ..... A61J 9/00; A61J 9/06

[52] U.S. Cl. ..... 215/11.1; 248/102

[58] Field of Search ..... 215/11.1, 100 R, 100.5; 248/102, 104, 105; 606/234–236

[56] References Cited

U.S. PATENT DOCUMENTS

| | | | |
|---|---|---|---|
| 1,987,132 | 1/1935 | Shine | 248/104 |
| 2,733,883 | 2/1956 | Gourley | 248/102 X |
| 3,017,051 | 1/1962 | Rosenfeld | 215/100.5 |
| 3,058,708 | 10/1962 | Murray et al. | 248/102 |
| 3,405,829 | 10/1968 | Siravo | 215/11.1 X |
| 4,050,600 | 9/1977 | Jennings | 215/11.1 |
| 4,688,571 | 8/1987 | Tesler | 606/234 |
| 4,759,453 | 7/1988 | Paetzold | 215/11.1 |
| 4,832,214 | 5/1989 | Schrader et al. | 215/11.1 |

FOREIGN PATENT DOCUMENTS

| | | | |
|---|---|---|---|
| 2594328 | 8/1987 | France | 128/360 |
| 2169811 | 7/1986 | United Kingdom | 606/234 |

*Primary Examiner*—Sue A. Weaver

*Attorney, Agent, or Firm*—Charles I. Brodsky

[57] ABSTRACT

The leakage preventing baby bottle of the invention incorporates a collar inserted over the neck of the bottle, supported by the body of the bottle and held in place by the screw-on nipple cap employed. For a cylindrically shaped bottle, the collar is selected of a greater diameter dimension than that of the bottle itself so as to prop the bottle at an upwardly directed angle to prevent the nipple from leaking or dripping even at such times as the infant, or toddler, is not sucking, and with the bottle at rest. In a preferred embodiment of the invention, the collar is comprised of a pair of see-through apertured disks, sandwiched together, and with the lower one being provided with a luminous coloration along its circumference to enhance easy-finding in a darkened environment.

3 Claims, 2 Drawing Sheets

LEAKAGE PREVENTING BABY BOTTLE

FIELD OF THE INVENTION

This invention relates to baby bottles, in general, and to a leakage preventing baby bottle, in particular.

BACKGROUND OF THE INVENTION

As every parent has experienced, babies and toddlers oftentimes cry in their cribs and beds simply because they are unable to locate the baby bottle on which they had been sucking. As all these parents have experienced, once the nipple and bottle have been replaced, the crying stops. But more important than that, one of the banes of new parenting is that when the bottle is not being used by the infant, it generally lies in a horizontal position, and the milk, juice, or water, etc. inside tends to drip—and onto the bedsheet, onto the couch, onto the carpeting, etc. and, in general, onto any surface where the infant is lying while sucking. As will also be apparent, even if one were only talking about a crib-sheet which would have to be cleaned anyway, the bottle many times falls from the crib to the floor, and then continues to drip onto the rug, or carpeting, in that area. Over a period of time, such dripping or leakage—even where the bottle cap is screwed on tightly—can give rise to staining and other discoloration. And, when one appreciates the fact that there can be dripping or leakage not only from the nipple hole itself but from the spacing between the nipple and the aperture in the cap in which it sits, the staining/discoloration problem can be aggravated with the bottle resting in its horizontal position on the floor, bed, etc.—especially when the baby bottle contains a large amount of fluid.

SUMMARY OF THE INVENTION

As will become clear hereinafter, the leakage and dripping problem associated with baby bottles presently available is obviated by incorporating a collar which inserts over the neck of the bottle, is supported by the body of the bottle, and which extends beyond the dimensions of the bottle so as to prop the bottle at an upwardly directed angle when the bottle would otherwise lie horizontally. When held in place by the screw-on nipple cap, and for a baby bottle of generally cylindrical construction, the collar may take the form of an overlying disk, typically to extend a full 2 inches or so beyond the bottle, so as to elevate the cap and nipple at an angle of approximately 20°-25°. In such manner, whatever the fluid contained, and no matter what the volume of fluid may be, the fluid then directs to the bottom of the bottle by gravity, and leakage from the hole in the nipple, or in the space surrounding the nipple in the cap are each prevented.

In accordance with the invention, the collar is comprised of a pair of see-through apertured disks, which are sandwiched together, and with the lower one being provided with a luminous coloration along its circumference. By being sandwiched, the top disk prevents the coloration from being ingested if chewed upon, and the see-through nature of the disks affords the luminescence helpful in locating the bottle by the infant or toddler in a darkened environment, either in the crib, the carriage, or the carrier for an automobile—and, even, assist the adult in locating the bottle if it should fall through the crib at night.

BRIEF DESCRIPTION OF THE DRAWING

These and other features of the present invention will be more clearly understood from a consideration of the following description taken in connection with the accompanying drawing, in which.

DETAILED DESCRIPTION OF THE DRAWING

Figure 1:
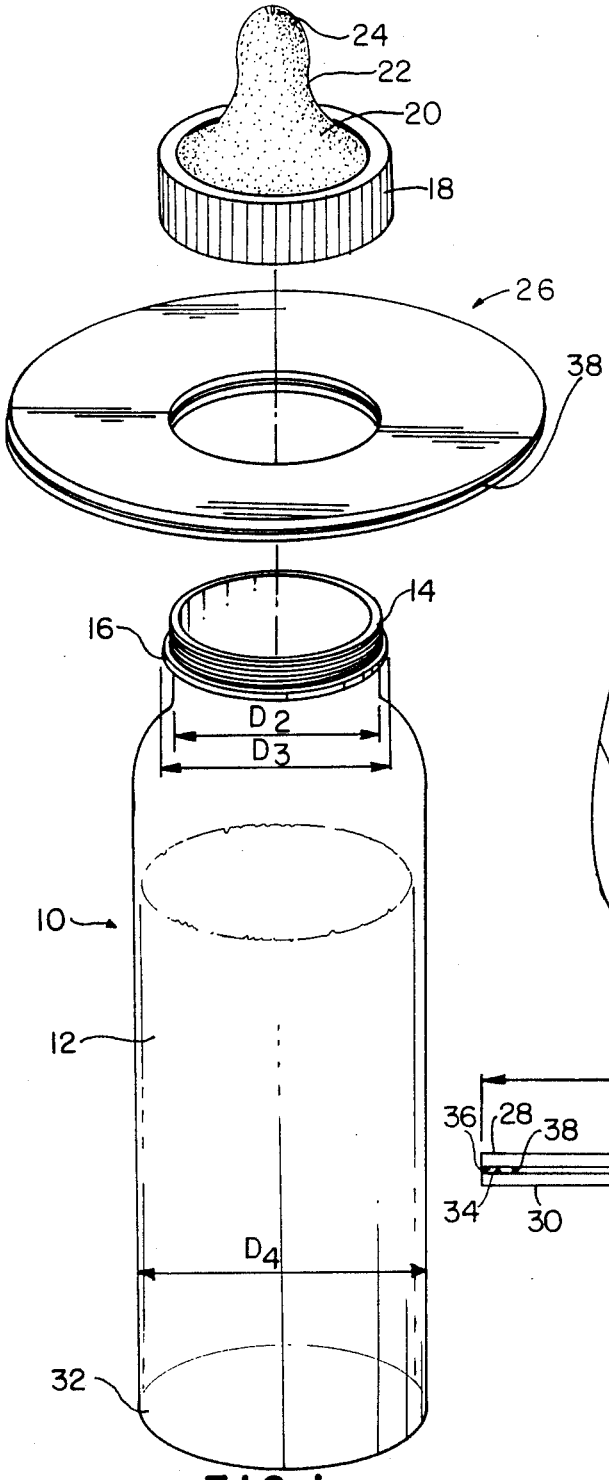
FIG. 1 is a disassembled view of a leakage preventing baby bottle constructed in accordance with the teachings of the present invention.

Referring to the drawing, the leakage preventing baby bottle of the invention includes a bottle 10 having a cylindrical body portion 12 and a neck portion 14—and, with the neck portion 14 having a typical ridge 16 to enable a screw-on lock with the bottle cap 18. As is well known, the bottle cap 18 is apertured, as at 20, to accept the nipple 22, inserted as shown for use, and understood to be inverted and closed off with an overlying seal when stored away. As will be appreciated, if filled with milk, juice, sweet-water or other fluid and maintained in a generally horizontal position, parallel to the ground, for example, there exists a very definite tendency for the fluid to leak and/or drip from the hole in the nipple 24 and from the aperture area 20 in the cap 18.

Also shown in the drawing is the collar of the invention 26, comprised of a pair of see-through apertured disks 28, 30, each of which may have an inner diameter $D_1$ slightly larger than the diameter $D_2$ of the neck portion 14, but of a diameter slightly less than the diameter $D_3$ of the ridge 16, so as to be held in place thereby. With such construction, the collar 26 will then be held in place, supported by the ridge 16 when the cap 18 is screwed onto the bottle 10. In other alternative arrangements, wherein the ridge 16 was located proximate to the body portion 12, then an alternative location for the collar 26 would be to seat atop the upper most end of the body portion 12 of the bottle 10, to be again secured in place by closure of the bottle cap 18, and to then be supported by the bottle 10, with the inner diameter $D_1$ of the disks 28, 30, then being slightly larger than the diameter $D_3$ of the ridge 16 but less than the diameter $D_4$ of the bottle body 12.

Figure 2:
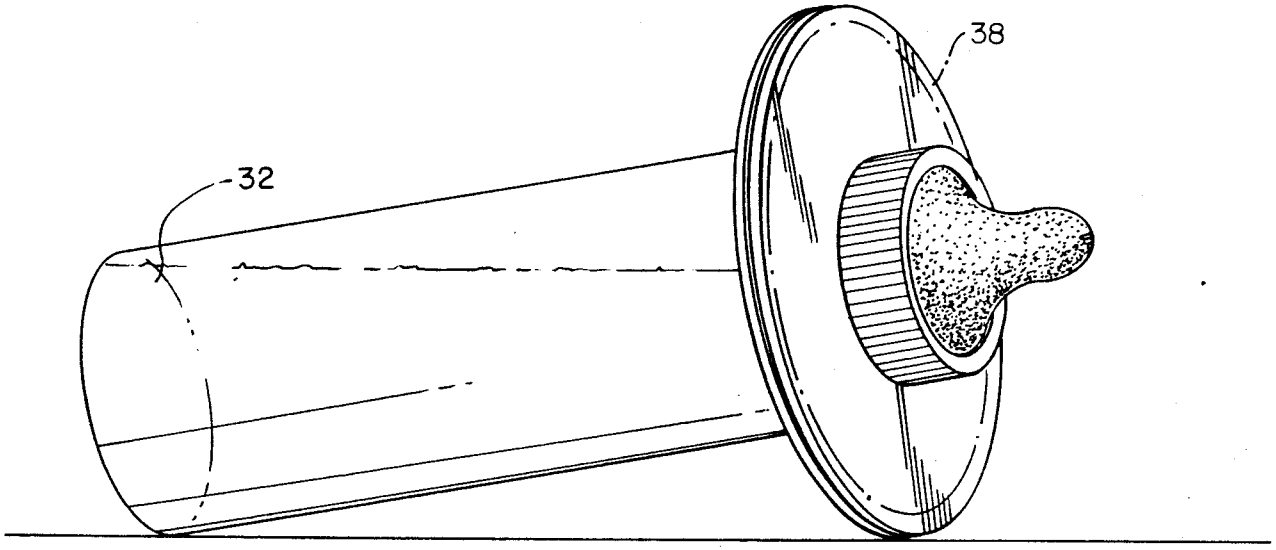
FIG. 2 is a perspective view of the baby bottle of the invention helpful in an understanding of its use.

In either of the above alternative constructions, on the other hand, the outer diameter $D_5$ of the disks 28, 30 is selected greater than the diameter $D_4$ of the bottle 10. With a typical bottle diameter $D_4$ of $1\frac{1}{2}''$-$2''$, the outer diameter $D_5$ of the disks 28, 30 may be of the order of 6" so as to prop the bottle 10 at an upward angle when the bottle is not being used, as when falling from the infant's or toddler's mouth (FIG. 2). In such arrangement, gravity forces the flow of the fluid or liquid backwardly towards the bottom 32 of the bottle so that leakage or drippage does not occur even if the bottle were filled to capacity.

Figure 3:
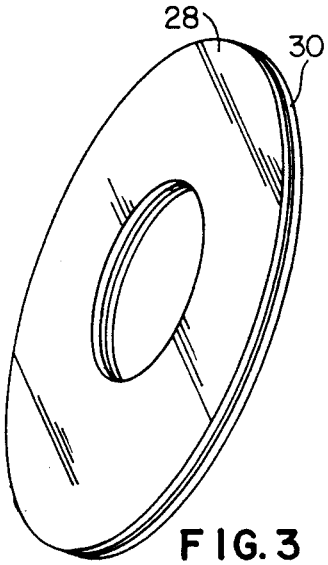
FIG. 3 is a perspective view of the collar of the invention and its see-through apertured disks.
Figure 4:
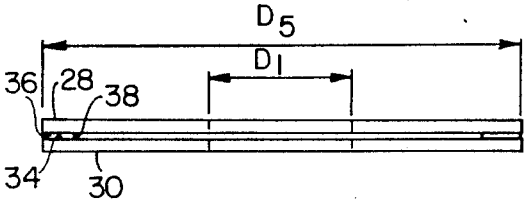
FIG. 4 is a side view of the collar of FIG. 3.

Referring to FIGS. 3 and 4, it will be appreciated that the lower disk 30 of the collar 26 has an upper surface 34 sandwiched together with the lower surface 36 of the disk 28. In accordance with the invention, between these two surfaces—or incorporated at the circumference of either one of them—is an area of luminous coloration 38, traversing the rim of these surfaces and the collar 26, so as to enhance the easy-finding of the bottle in a darkened environment. Although it might be possible to enhance the depth of this rim 38 inwardly of the disks 28, 30, it has been found preferable to restrict such depth so as not to interfere with the vision of the infant or toddler generally looking straight ahead, through the collar 26 when drinking or sucking.

In general use of the invention, the collar 26 is emplaced for use and then secured by the closure of the cap 18 on the bottle 10. This is the general arrangement, even where the infant or toddler is being supported, and someone else is holding the bottle. When the infant or toddler is holding the bottle himself, or herself, the collar remains in place, and continues there on those instances when the bottle should happen to be either placed, or fall, away. In use, the collar 26 is removed only during such times as the bottle and nipple are being cleaned, or stored away. But, as will be appreciated, the collar serves to raise the bottle at an angle to prevent leakage or dripping, and can easily be found—with both such features being affordable when the collar 26 is constructed of a stiff enough material to retain the bottle at its upwardly directed angle at a time when the bottle is not being utilized, and would otherwise rest horizontally.

While the present invention has been described in its preferred embodiments, it will be appreciated by those skilled in the art that modifications can be made without departing from the scope of the teachings herein. For example, although set forth in an environment in which the bottle employed is of a generally cylindrical construction, it will be appreciated that the teachings of the invention could also be employed with bottles of alternative design—with or without handles, and whether of conventional or unique shape, as long as a collar is employed around the neck of the bottle, or elsewheres, so as to prop the bottle at an upwardly directed angle when not in use. For at last such reason, therefore, resort should be had to the claims appended hereto for a correct understanding of the invention.

I claim:

1. The combination comprising:

a baby bottle having an open neck portion and also having a body portion of given width;

a cap having a predetermined width and with a nipple closing off said neck portion;

and a collar surrounding said bottle adjacent said neck portion;

with said collar being secured in place against said neck portion by said cap;

with said collar having an outer dimension greater than the width of said body portion;

wherein said baby bottle has a body portion of given diameter and wherein said collar is of a generally annular configuration having an outer diameter greater than the diameter of the body portion;

wherein said baby bottle has a neck portion of given diameter and wherein such collar also has an inner diameter greater than the diameter of said neck portion;

wherein the inner diameter of said collar is less than the diameter of said body portion;

wherein said collar is composed of a pair of overlying annular discs, each having upper and lower surfaces;

wherein an outer circumferential edge of at least one of the lower surface of said top-most disc and the upper surface of said bottom-most disc is luminescent; and wherein except for said circumferential edge, each of said pair of overlying discs are composed of a see-through material.

2. The combination of claim 1 wherein an outer circumferential edge of the lower surface of said top-most disc and the upper surface of said bottom-most disc are both luminescent.

3. The combination of claim 1 wherein the outer diameter of each of said annular discs is of the order of 3–4 times the diameter of the body portion of said baby bottle.

* * * * *